US005860549A

United States Patent [19]

Allers et al.

[11] Patent Number: 5,860,549

[45] Date of Patent: Jan. 19, 1999

[54] CONTAINER FOR STABILIZING A FOOD DISH

[75] Inventors: Brian Scott Allers, Poughkeepsie; Edward W. Rider, Jr., Slate Hill, both of N.Y.

[73] Assignee: Genpak, L.L.C., Glens Falls, N.Y.

[21] Appl. No.: 534,692

[22] Filed: Sep. 27, 1995

[51] Int. Cl.[6] ..... B65D 6/38; B65D 43/16

[52] U.S. Cl. ..... 220/4.23; 220/23.87; 220/23.89; 220/337; 220/527; 220/671; 220/675; 220/780; 220/805

[58] Field of Search ..... 220/4.23, 658, 220/339, 426, 427, 527, 574, 574.3, 4.21, 4.22, 4.24, 23.83, 23.87, 23.89, 334, 337, 675, 669, 671, 780, 805; 206/45.32, 551; 312/285

[56] References Cited

U.S. PATENT DOCUMENTS

| | | | |
|---|---|---|---|
| 547,759 | 10/1895 | Baraban | 220/427 X |
| 1,516,775 | 11/1924 | McCarron . | |
| 1,573,620 | 2/1926 | Allston . | |
| 1,908,806 | 5/1933 | Allen . | |
| 2,575,299 | 11/1951 | Scheel | 126/261 |
| 2,845,104 | 7/1958 | Frankel | 220/4.23 |
| 2,915,001 | 12/1959 | Montgomery | 99/339 |
| 3,233,813 | 2/1966 | Wolford et al. | 220/658 X |
| 3,550,803 | 12/1970 | Pelli | 220/23.87 |
| 3,770,115 | 11/1973 | Cannell | 206/45.32 |
| 4,375,862 | 3/1983 | Kurinsky et al. | 206/45.32 X |
| 4,478,349 | 10/1984 | Haverland, Jr. et al. | 220/410 |
| 4,811,846 | 3/1989 | Bottega | 206/542 |
| 4,874,083 | 10/1989 | Antoni et al. | 206/45.32 |
| 4,984,691 | 1/1991 | Jones | 206/506 |
| 4,986,438 | 1/1991 | Borst | 220/315 |
| 4,994,638 | 2/1991 | Iorns et al. | 219/10.55 E |
| 5,011,034 | 4/1991 | Abel | 220/23.8 |
| 5,046,659 | 9/1991 | Warburton | 229/2.5 |
| 5,092,479 | 3/1992 | Wells | 220/4.23 |
| 5,266,763 | 11/1993 | Colombo | 220/23.87 |
| 5,269,430 | 12/1993 | Schlaupitz et al. | 220/4.23 |
| 5,300,748 | 4/1994 | Colombo | 219/734 |
| 5,339,973 | 8/1994 | Edwards et al. | 220/4.23 |

FOREIGN PATENT DOCUMENTS

| | | |
|---|---|---|
| 383677A | 8/1990 | European Pat. Off. . |
| 2061880 A | 5/1981 | United Kingdom . |

*Primary Examiner*—Allan N. Shoap
*Assistant Examiner*—Niki M. Eloshway
*Attorney, Agent, or Firm*—Heslin & Rothenberg, P.C.; Wayne F. Reinke, Esq.

[57] ABSTRACT

A container for housing a food dish includes a receiving shell defining a first cavity and a cover shell that is releasably lockable to the receiving shell for providing a cover with a second cavity over the first cavity. The cover shell has side walls with inward projections for entrapping the food dish seated within the receiving shell when the cover shell is releasably locked to the receiving shell.

31 Claims, 7 Drawing Sheets

CONTAINER FOR STABILIZING A FOOD DISH

TECHNICAL FIELD

The present invention is generally related to a container for housing a food dish. More specifically, this invention relates to a container for housing and stabilizing a pie tin.

BACKGROUND OF THE INVENTION

It is known to use containers for packaging and transporting bakery goods. In packaging, for example, a lemon meringue pie, the pie and associated pie tin are packaged in a container for storage and shipping. Because existing containers do not stabilize the pie tin, the lemon meringue pie may be tossed upward within its container during shipping, causing the meringue to contact a lid of the container. As a result, the appearance and quality of the pie may become damaged.

Another problem of such containers concerns vulnerability of the pie tin to deformations, should the container bump external objects. If the bottom of the pie tin rests directly on the floor of the shipping container, then the bottom of the tin can be deformed when struck, via the floor of the container, by an external object. Similarly, the side walls of the pie tin are vulnerable to this type of damage if disposed in direct contact with associated walls of the container.

In the past, containers have included bottom and top portions hinged together by an interconnecting hinge member. In folding the top portion over the bottom portion, the hinged member may not fold predictably. As a result, the top portion may become misaligned with respect to the bottom portion during packaging.

Accordingly, there exists a need for a way to house and transport pies and the like that avoids the structural and functional disadvantages associated with conventional pie tin containers.

SUMMARY OF THE INVENTION

It is an object of the present invention to provide an improved container for housing a pie tin.

It is a further object of the present invention to provide such a container that stabilizes the pie tin both vertically and laterally.

Another object of the present invention is to provide a container for pie tins that protects the tin from shock and damage by external blows.

Another related object is to provide such a container that seals against air and water.

Still yet another object of the present invention is to provide such a container for pie tins that may be readily assembled.

The above and other objects are realized, in accordance with the features of the present invention, by provision of a container for housing a food dish, the container comprising a receiving shell defining a first cavity and a cover shell releasably lockable to the receiving shell for providing a cover with a second cavity over the first cavity. The cover shell has a side wall with at least one inward projection that entraps an edge of the food dish when seated within the receiving shell and the cover shell is releasably locked to the receiving shell.

In accordance with one aspect of the present invention, the receiving shell of the above container includes a wall with a plurality of inwardly directed ribs for preventing lateral movement of the food dish when seated therein.

In a further aspect of the present invention, the food dish is a pie tin having a crimped rim about an outer peripheral flange thereof. At least one of the plurality of inwardly directed ribs of the receiving shell includes a plateau shoulder for supporting the flange of the pie tin. The inwardly directed projection of the cover shell and the plateau of the shoulder of the receiving shell define a vertical clearance therebetween of a thickness less than the crimped rim of the pie tin. Accordingly, when the cover shell is releasably locked to the receiving shell with the pie tin seated therein, the inward projection of the cover shell exerts an entrapment force upon the rim of the pie tin against the plateau shoulder of the associated rib of the receiving shell.

In a second embodiment of the present invention, the container is a monolithic structure with the receiving shell and the cover shell pivotally inter-coupled by a hinge member. The hinge member has a first flange extension union with a flange of the receiving shell and a second flange extension union with a flange of the cover shell. The first and second flange extensions have compatible protrusion and nesting recess features respectively for assisting lateral alignment of the cover shell over the receiving shell before being releasably locked thereto.

In one aspect of this second embodiment of the present invention, the hinge member has a cross-section orthogonal to a fold line thereof that includes two substantially circular U-shaped valleys joined therebetween by a substantially squared intermediate interconnection.

In another aspect of this second embodiment of the present invention, the cross-section of the hinge member comprises two substantially squared U-valleys joined therebetween by a substantially squared intermediate joint.

A further aspect of this second embodiment of the present invention provides tabs on respective flanges of the receiving shell and the cover shell. The tab positions are offset relative one another so that they may be readily manipulated for unlocking the cover shell from the receiving shell for opening the container.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following detailed description of the preferred embodiment and the accompanying drawings in which:

DESCRIPTION OF THE PREFERRED EMBODIMENTS

Figure 3:
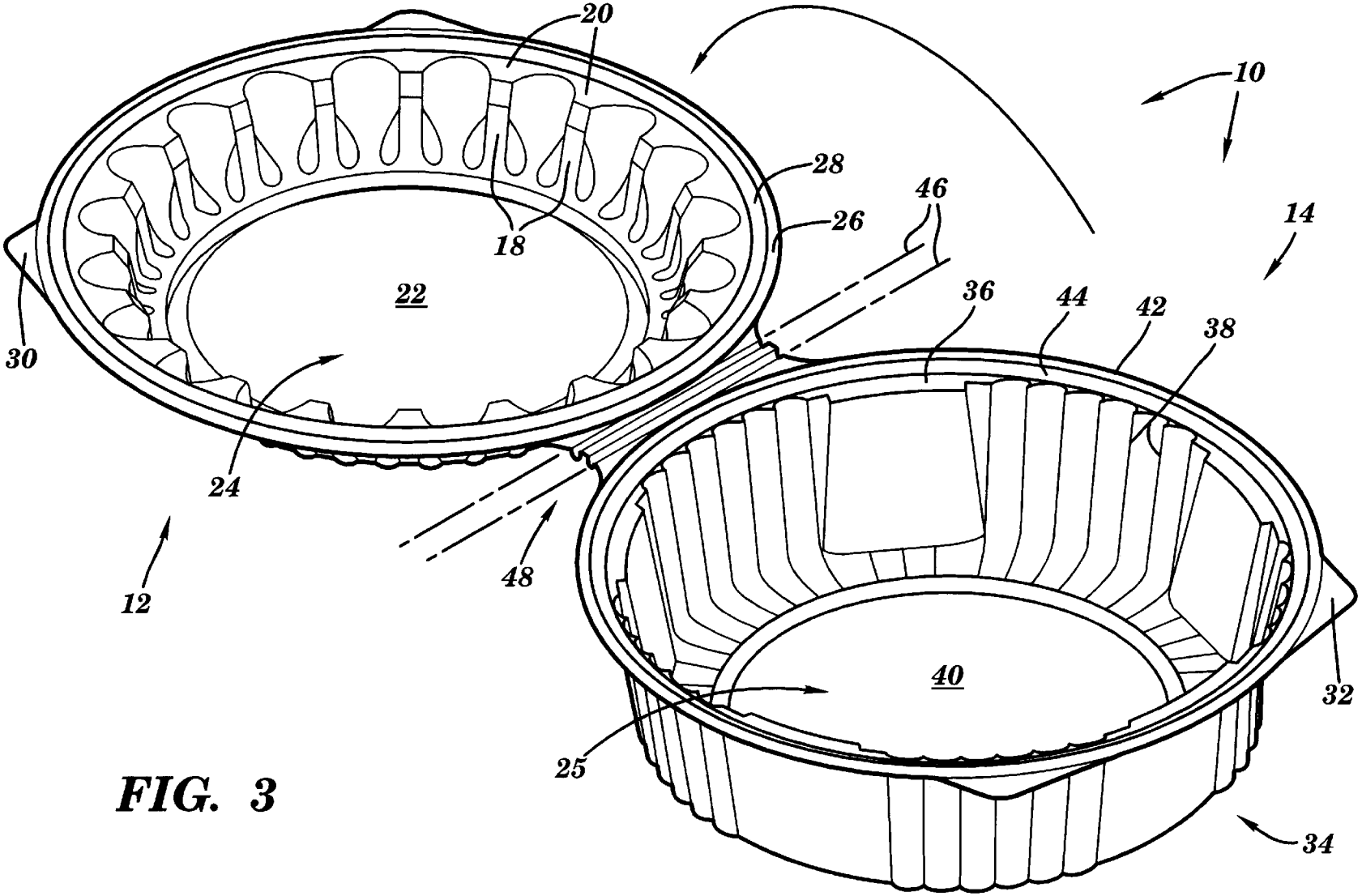
FIG. 3 is an isometric view of the container of the present invention.

With reference to FIG. 3, container 10 comprises receiving shell 12 and cover shell 14 pivotally interconnected by hinge member 48. Receiving shell 12 defines a first cavity 24 for receiving, for example, a pie tin, while cover shell 14 defines a second cavity 25 that provides clearance over receiving shell 12 when secured thereto. Preferably, container 10 is formed of a clear plastic material of known type and molded per known techniques of the packaging industry.

In a preferred embodiment of the present invention, container 10 is a monolithic structure comprising receiving shell 12, cover shell 14 and hinge member 48. In an alternative embodiment of the present invention (not shown), the hinge member is not provided, wherein the receiving shell and cover shell are provided as two separate structures.

Receiving shell 12, in its preferred embodiment with reference to FIGS. 1A, 2A, 3 and 4, defines a circular housing per its first cavity 24 for receiving a circular pie tin 50 therein. However, it will be understood that receiving shell 12, along with the overall associated container 10 of the present invention, may take on other shapes (not shown) as required for accommodating products and food dishes of different configurations.

Figure 4:
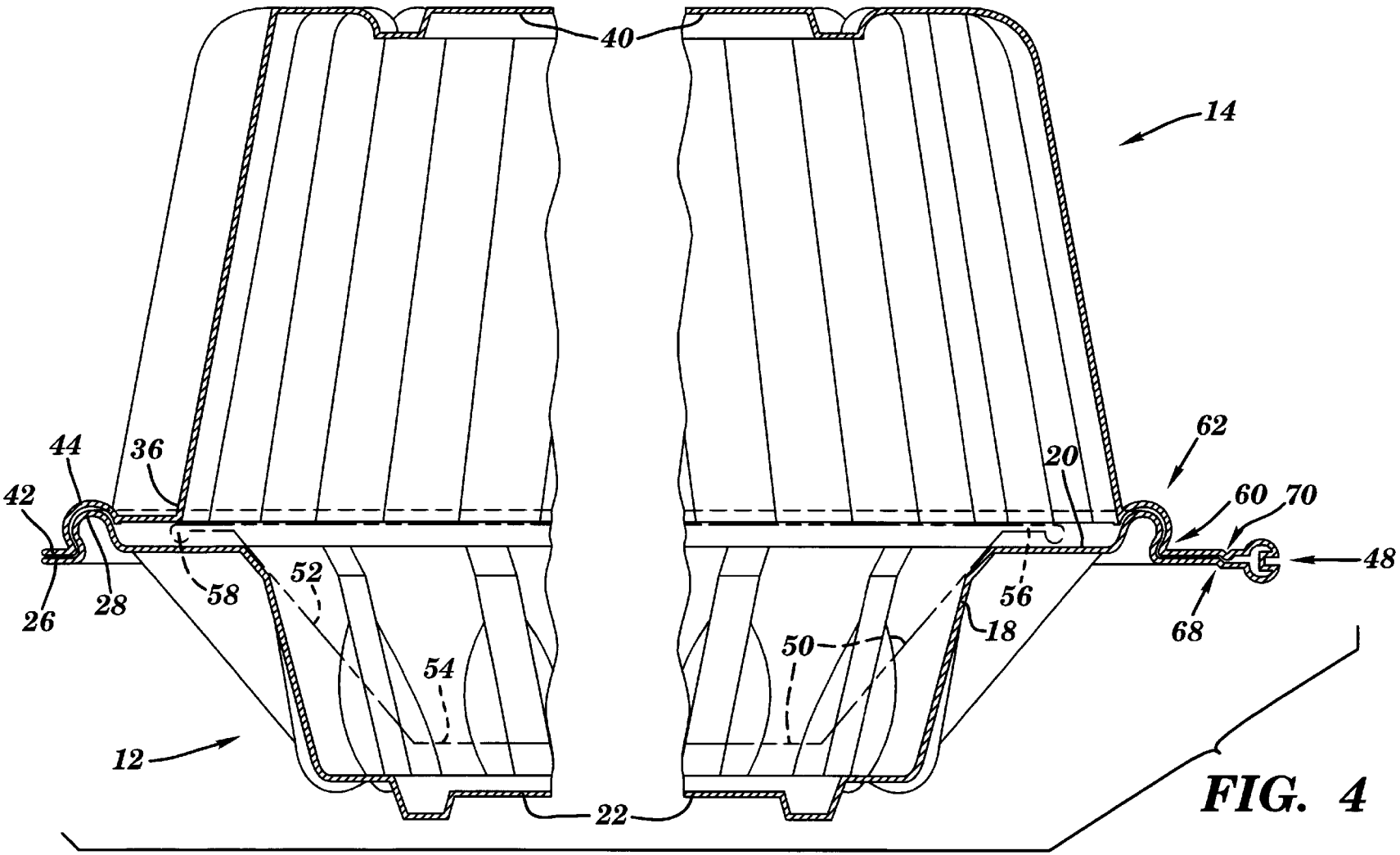
FIG. 4 is a partial cross-sectional side view of the container of the present invention housing a pie tin therein.

The side walls of receiving shell 12 include ribs 18 that define a conic boundary for meeting the sloped side walls 52 of pie tin 50 (as shown in phantom in FIG. 4). Ribs 18 have multi-pitched cross-sectional side profiles, i.e. steep slopes proximate floor 22 and more gradual gradients proximate the plateau shoulders, for accommodating a variety of differently shaped pie tins. In operation, when a pie tin is seated within the receiving shell, ribs 18 prevent lateral movement of the pie tin during shipping. The ribs also form a buffer zone for protecting the walls of the pie tin from shock and deformation that might result from blows of an external object. The protective buffer zone is formed in accordance with the associated depth/thickness of the inwardly directed ribs 18 relative the outer radius of the associated walls of the receiving shell. Accordingly, should the container bump an external object during shipping, the outer side walls of the receiving shell deform to absorb the shock of the blow and protect the pie tin from damage and/or deformation, while the pie tin remains suspended within the inner conic boundary defined by ribs 18.

Plateau shoulders 20 at the top of ribs 18 support flange 56 of pie tin 50. Preferably, ribs 18 and plateau shoulders 20 support pie tin 50 with its floor 54 in spaced relationship suspended above floor 22 of receiving shell 12. In this relationship, floor 22 of receiving shell 12 provides a protective buffer zone for protecting the floor of the pie tin by absorbing external blows from below.

Figure 1A:
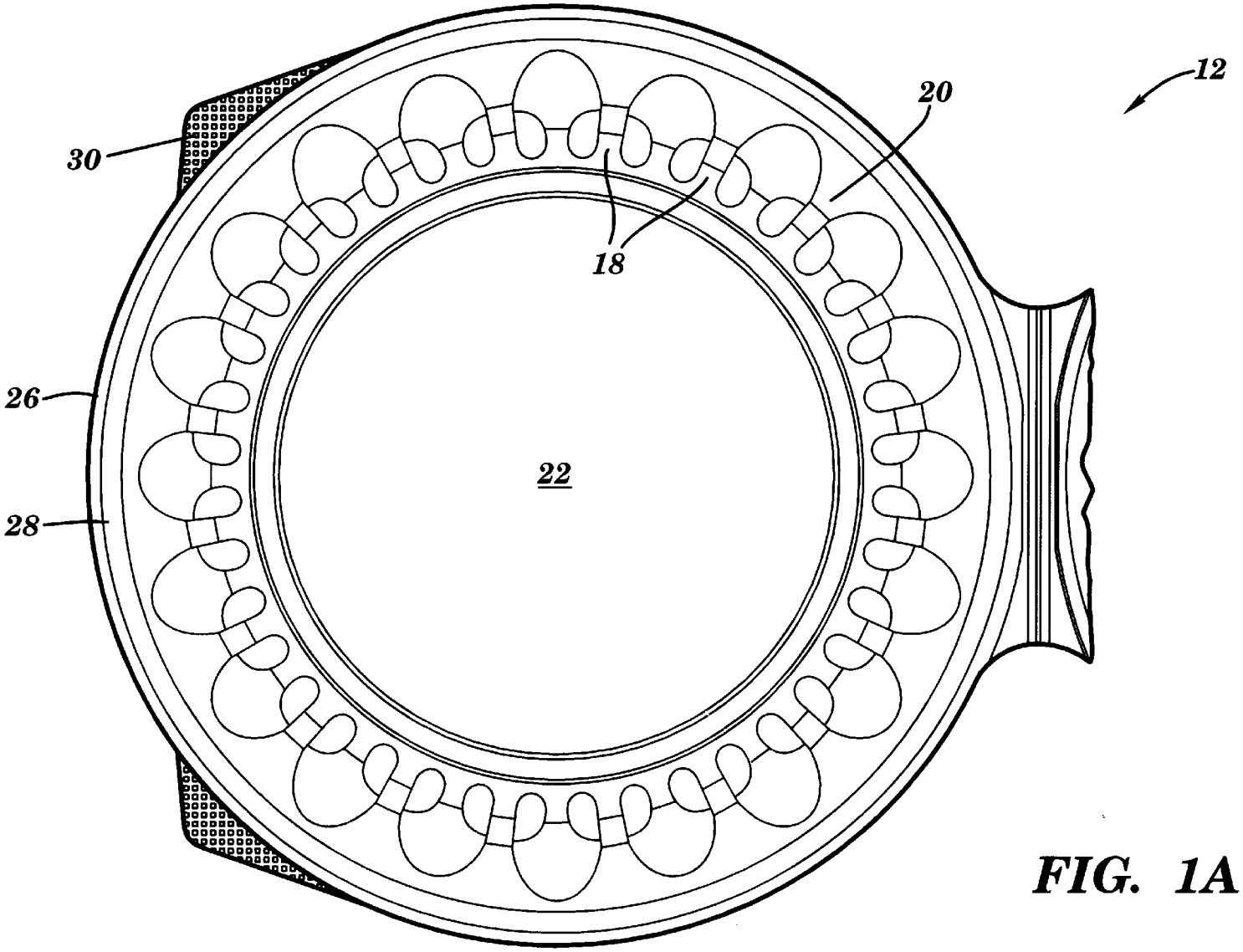
FIG. 1A is a top plan view of a first portion of a container of the present invention.
Figure 1B:
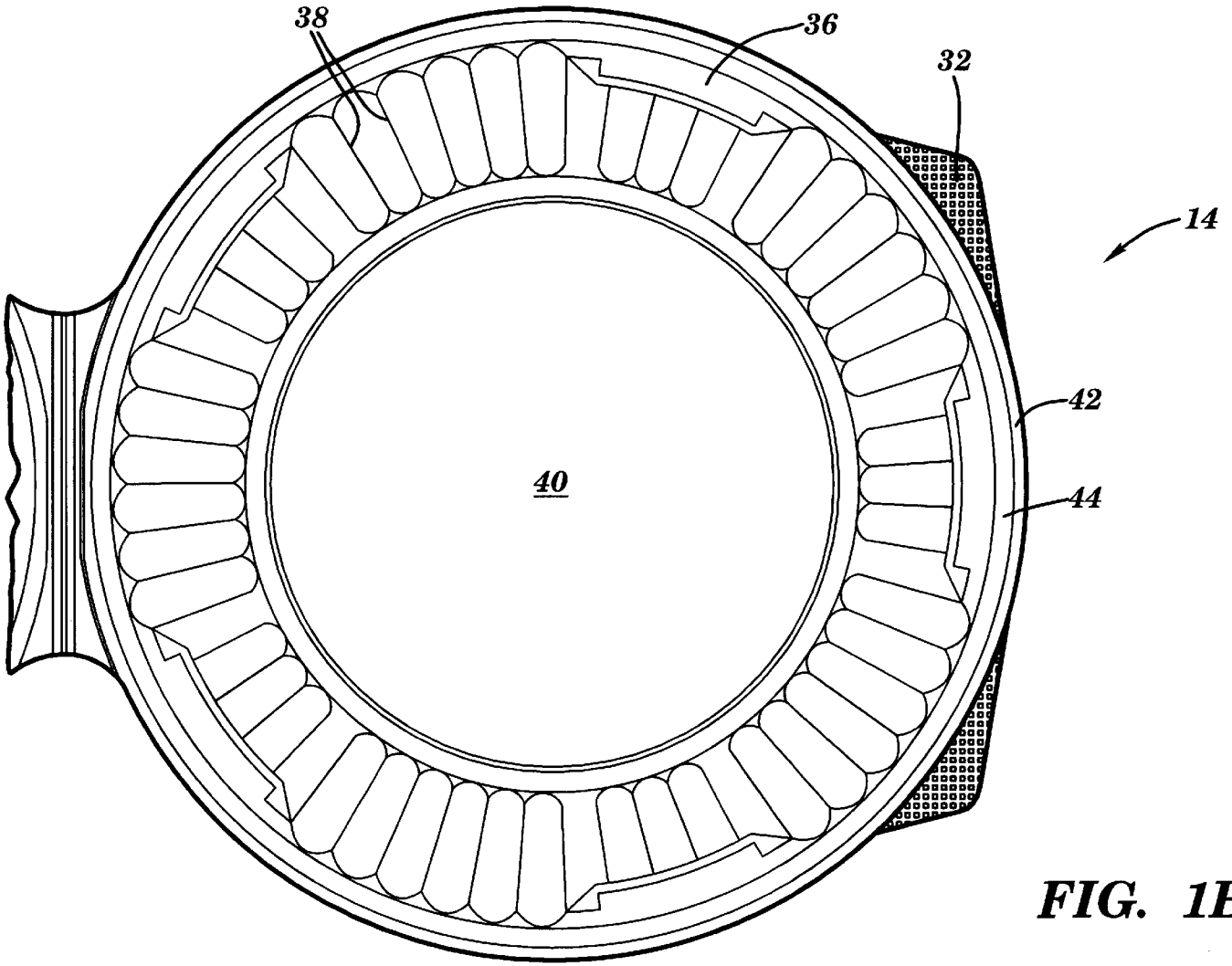
FIG. 1B is a top plan view of a second portion of the container of the present invention.
Figure 2A:
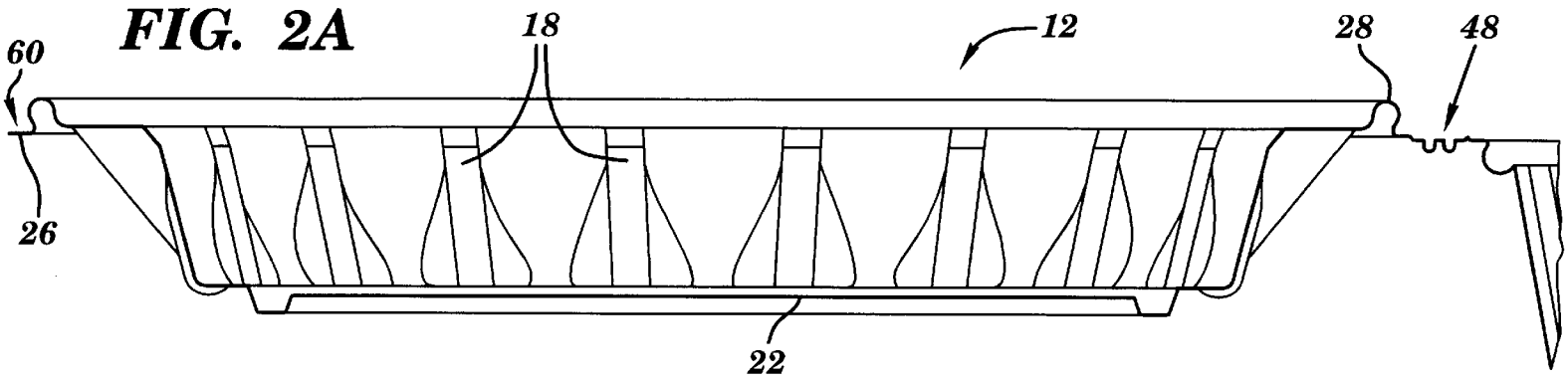
FIG. 2A is a cross-sectional side elevation view of the first portion of the container as shown in FIG. 1A.
Figure 2B:
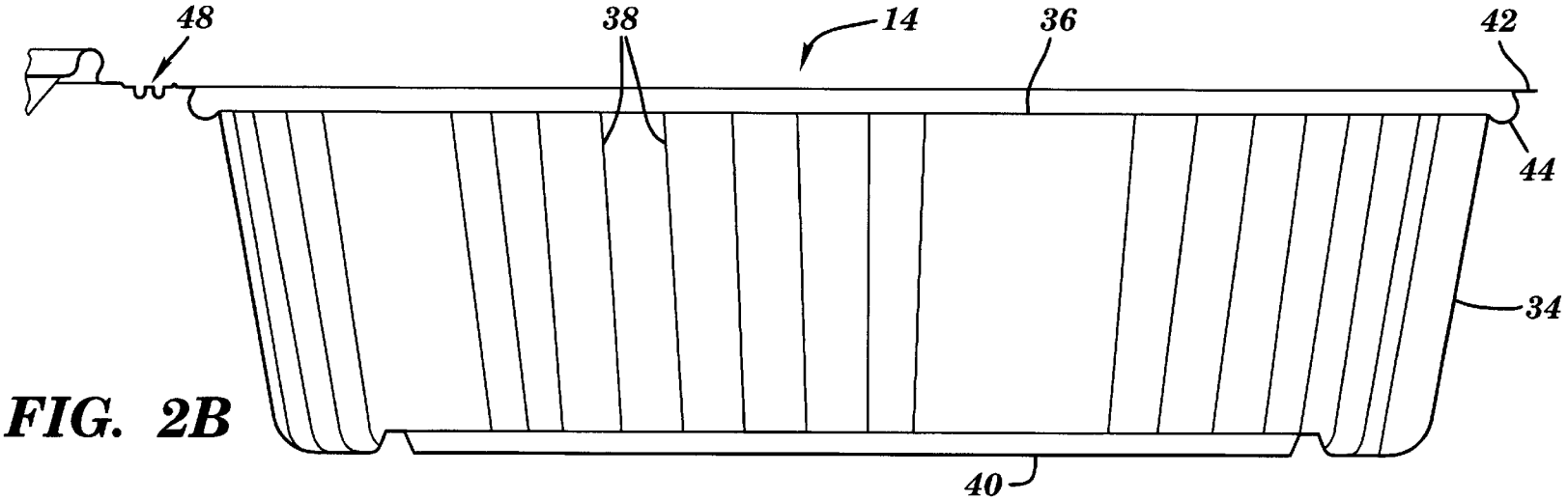
FIG. 2B is a cross-sectional side elevation view of the second portion of the container as shown in FIG. lB.

An upper flange 26 surrounds the periphery of receiving shell 12. Molded in flange 26 is a male engagement snap-fit protrusion 28 that rims an inner radius of the flange. With reference to FIGS. 2A and 4, the male engagement snap-fit protrusion 28 has primarily a circular cross-section that defines an under-cut/overhang portion 60 relative its associated flange 26. The undercut enables snap-fit mating of the male snap-fit protrusion 28 with an associated mating member of cover shell 14. In accordance with one aspect of this embodiment for the present invention, the snap-fit protrusion 28 has a cross-sectional arc-span that spans at least 180 degrees, and preferably 200 to 340 degrees.

Cover shell 14, with reference to FIGS. 1B, 2B, 3 and 4, has an outer radial shape corresponding to receiving shell 12, so that it may cover the housing of the receiving shell. Roof 40 and side walls 34 of cover shell 14 define a second cavity 25 having a depth sufficient for clearing contents seated within receiving shell 12, for example, the meringue of a lemon meringue pie. Structural support ribs 38 are formed within side walls 34 of cover shell 14 for improving the strength thereof.

As one feature of the present invention, side walls 34 of cover shell 14 include entrapment projections 36 which are directed inwardly into second cavity 25. When cover shell 14 is secured over receiving shell 12, with a pie tin seated within the receiving shell as shown in FIG. 4, entrapment projections 36 capture crimped rim 58 of pie tin 50 for preventing the pie tin from shifting vertically within the container. Preferably, the clearance between the entrapment projections 36 and the plateau shoulders 20 is designed to be less than the thickness of crimped rim 58 of pie tin 50. Thus, when cover shell 14 is locked over the receiving shell, the entrapment projections 36 exert an entrapment force upon crimped rim 58 of the pie tin 50, pressed against shoulders 20 of ribs 18 of the receiving shell.

In a preferred embodiment of the present invention, the entrapment projections 36 project inward just enough to slightly capture the crimped rim 58 of the pie tin. Thus, a pie crust may be provided over flange 56 of the pie tin without being crushed by the entrapment projections of the cover shell. For such applications, it is further preferable that a pie or other food, which is to be stored within the container, be formed with its crust trimmed away from the crimped rim so that the crust does not interfere with securement by the entrapment protrusions.

In a further aspect of the preferred embodiment of the present invention, the entrapment projections 36 each have a width associated therewith for meeting a corresponding partial circumference of the crimped rim 58 of the pie tin. The widths of projections 36 should each extend at least ¼ inch, or alternatively an arc-span of at least 5° degrees, relative the circumference of crimped rim 58. More preferably, the widths should extend 1–4 inches, or an arc-span of 10°–45°. The broad widths of the inward entrapment projections help prevent damage to a pie during entrapment, assuring that the crust of the entrapped pie is not shredded or similarly damaged during transport as might otherwise result from narrow/sharp entrapment projections.

The periphery of cover shell 14 includes flange 42 which is molded with a female nesting recess 44 for snap-fit securement to male engagement protrusion 28 of the receiving shell. In a preferred embodiment of the present invention, the female nesting recess has a cross-sectional arc-section 62 (as shown in FIG. 4) that conforms to an outer portion of the male protrusion 28 proximate its under-cut portion 60. This arc-section 62 of female nesting recess 44 meets its associated outer peripheral flange 42 of cover shell 14 so as to form an acute angle relative thereto. This acute angular joint, between arc-section 62 and associated flange 42, facilitates snap-fit engagement of female nesting recess 44 into the under-cut portion 60 of male engagement protrusion 28. These preferred cross-sectional mating arc-sections of male protrusion 28 and female nesting recess 44 respectively function to provide a releasable snap-fit locking seal of cover shell 14 to receiving shell 12—sealing against gases, vapors and liquids.

In one aspect of this embodiment of the present invention, arc-section 62 of the cross-section of female nesting recess 44 has an arc-span spanning beyond 90 degrees, and conforms to an associated contour of male engagement protrusion 28. In an alternative aspect of the present invention, the inner surface of the female nesting recess only partially conforms to the cross-section of the male engagement protrusion.

In the above description, the male engagement protrusion is associated with the receiving shell and the female nesting recess associated with the cover shell. It will be understood that the respective associations may be reversed.

Figure 5:
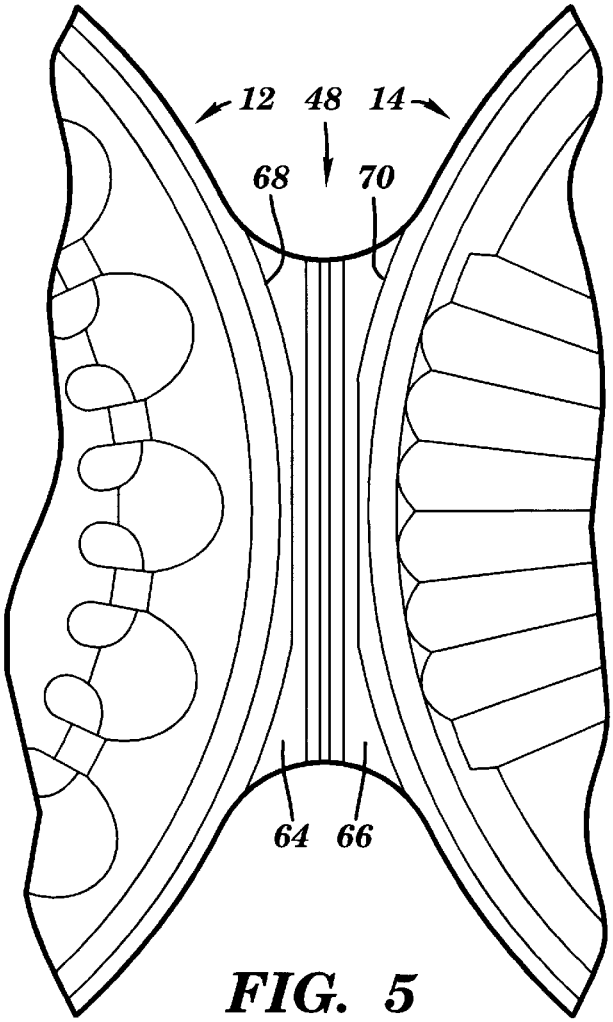
FIG. 5 is partial plan view showing a hinge member of the container of the present invention.
Figure 6A:
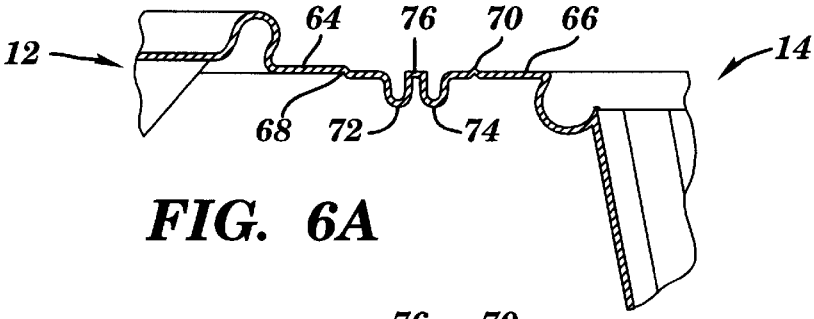
FIG. 6A is a cross-sectional side view of the hinge member of FIG. 5, in accordance with one embodiment thereof.
Figure 6B:
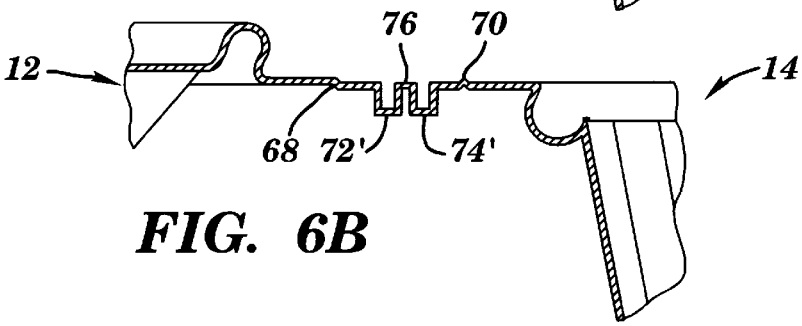
FIG. 6B is a cross-sectional side view of the hinge member of FIG. 5, in accordance with an alternative embodiment thereof.

In the preferred embodiment of the present invention, container 10 is a monolithic structure, wherein receiving shell 12 and cover shell 14 are pivotally joined together by hinge member 48. With reference to FIGS. 5, 6A and 6B, hinge member 48 includes a first flange extension 64 that extends outwardly from receiving shell 12 along a given portion of the periphery of flange 26, proximate cover shell 14. Similarly, hinge member 48 has a second flange extension 66 that extends outwardly from cover shell 14 along a given portion of the periphery of flange 42, proximate receiving shell 12. These first and second flange extensions 64,66 are joined together by a W-shaped hinge joint that runs the length of hinge member 48.

In one aspect of this preferred embodiment of the present invention, a cross-section of the W-shaped hinge joint comprises two squared U-shapes 72',74' joined together by a squared, flat-top interconnect 76, as shown in FIG. 6B. In an alternative aspect, the cross-section of the W-shaped hinge joint comprises two rounded U-shapes 72,74 joined together by a squared, flat-top interconnect 76, as shown in FIG. 6A. Preferably, the squared corners of the W-shaped hinge joint are relieved, with the associated material thicknesses thinned (not shown) along the corners, so as to provide predictable fold lines 46 (as shown in FIG. 3) for pivotally folding cover shell 14 over receiving shell 12.

To assist alignment during closure of the container, hinge member 48 includes protruding alignment ridge 70 and nesting recess/shelf 68. Protruding ridge 70 is molded within second flange extension 66 and runs along the length of hinge member 48, substantially parallel to the associated fold line 46. Near the distal ends of hinge member 48, the route of ridge 68 bends slightly inwardly along the circumference of receiving shell 12. Nesting recess/shelf 68 is molded within first flange extension 64 as an imprint complimentary to protruding ridge 70. In operation, when cover shell 14 is folded over receiving shell 12, protruding ridge 70 engages complimentary recess/shelf 68 so as to align cover shell 14 laterally with respect to receiving shell 12 before the two shells are closed together.

Figure 7:
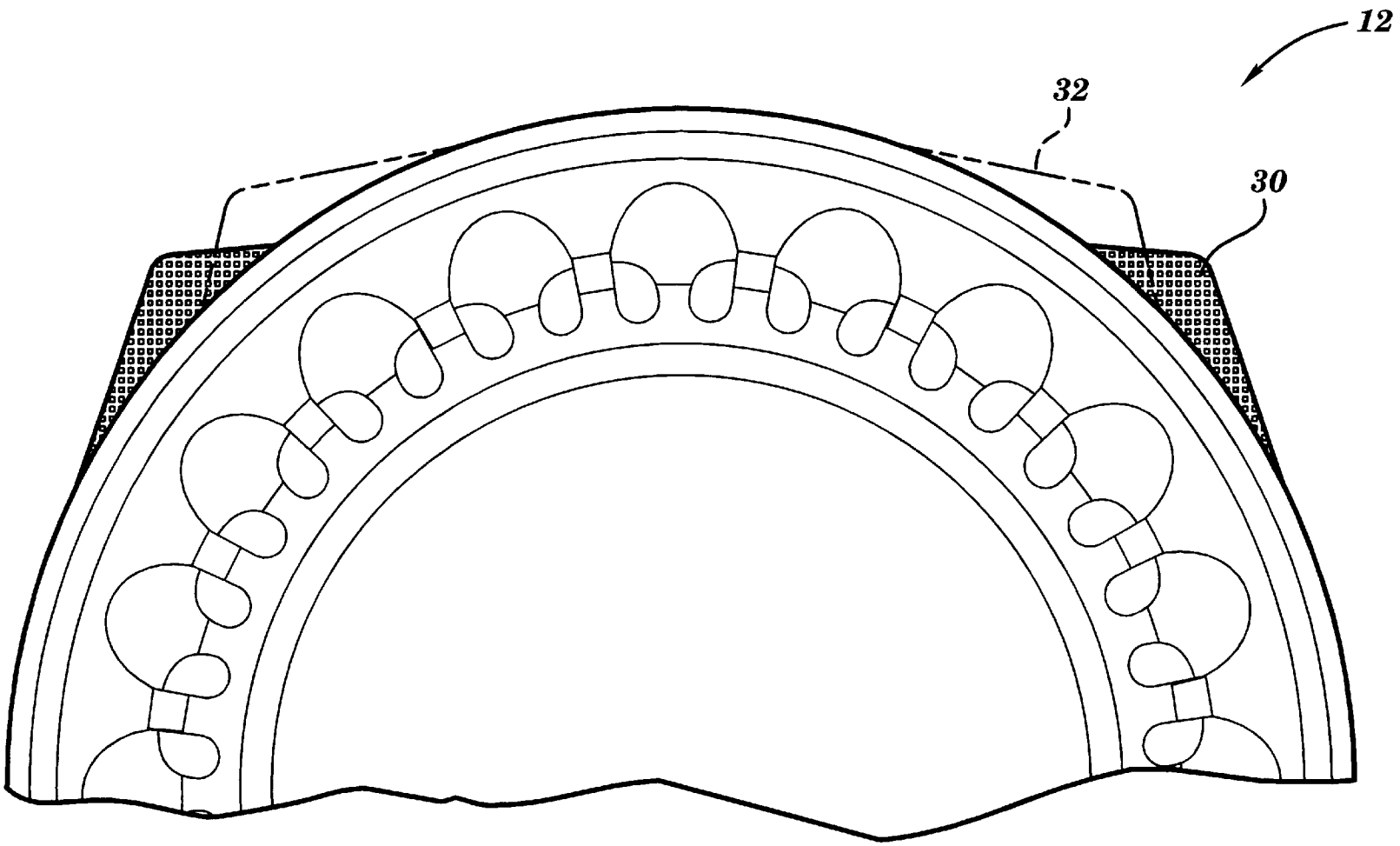
FIG. 7 is a partial top plan view showing tabs associated with the container of the present invention.

In a further aspect of the present invention, tabs 30,32 are provided on respective flanges 26,42 of the receiving and cover shells 12,14 respectively. Tabs 30,32 are placed on sides of the respective shells primarily opposite hinge member 48. With reference to FIG. 7, tab 32 of cover shell 14 (which is shown in phantom) is offset with reference to tab 30 of receiving shell 12 so as to assist ready manipulation thereof for unlocking cover shell 14 from receiving shell 12 and opening container 10.

While the invention has been particularly shown and described with reference to preferred embodiments thereof, it will be understood by those skilled in the art that various other changes in form and details may be made therein without departing from the spirit and scope of the invention.

What is claimed is:

1. A container for stabilizing a food dish including a bottom therein, said container comprising:

a receiving shell defining a first cavity for receiving the food dish, said receiving shell comprising a floor; and a cover shell releasably lockable to said receiving shell of providing a cover with a second cavity over said first cavity;

wherein said cover shell comprises a sidewall with at least one inward projection for effecting entrapment of an edge of the food dish when seated within said receiving shell and said cover shell is releasably locked to said receiving shell, and wherein the bottom of the food dish is suspended above said floor when seated within said receiving shell.

2. A container according to claim 1, wherein said receiving shell comprises a side wall with a plurality of inwardly directed ribs for preventing lateral movement of the food dish when seated therein.

3. A container according to claim 2, wherein at least one of said plurality of inwardly directed ribs comprises a plateau shoulder for supporting a peripheral flange of the food dish edge when seated in the receiving shell.

4. A container according to claim 3, wherein said plateau shoulder supports the food dish such that the bottom thereof is suspended above said floor of said receiving shell when seated therein.

5. A container according to claim 3, wherein said at least one inward projection of said cover shell and said plateau shoulder of said at least one of said plurality of inwardly directed ribs of said receiving shell define a vertical clearance plane therebetween of a thickness less than a rim of a pie tin so that when said cover shell is releasably locked to said receiving shell with the pie tin seated therein, said at least one inward projection of said cover shell exerts an entrapment force upon the rim of the pie tin against the plateau shoulder of said at least one of said plurality of inwardly directed ribs of said receiving shell.

6. A container according to claim 2, wherein said plurality of inwardly directed ribs define an inner conic shape for receiving and meeting an outer wall of the food dish and likewise assist in supporting the food dish such that the bottom thereof is suspended above said floor of said receiving shell when seated therein.

7. A container according to claim 6, wherein at least one of said plurality of inwardly directed ribs comprises a plateau shoulder for supporting said edge, and wherein said at least one of said plurality of inwardly directed ribs has a cross-sectional profile that is multi-pitched, steep proximate said floor of said receiving shell and more shallow proximate the plateau of the associated plateau shoulder.

8. A container according to claim 1, wherein said at least one inward projection has a width associated therewith for meeting a corresponding partial circumference of the edge of the food dish when seated within the container and the container is closed.

9. A container according to claim 8, wherein the width of said at least one inward projection extends an arc-span of at least 5° degrees relative to a circular outer circumference of the edge of the food dish when seated within the container and the container is closed.

10. A container according to claim 8, wherein the width of said at least one inward projection extends at least ¼ inch relative the circumference of the food dish when seated within the container and the container is closed.

11. A container according to claim 1, wherein one of said receiving shell and said cover shell comprises a flange coupled to a male engagement snap-fit protrusion along a periphery thereof, the male engagement snap-fit protrusion having a cross-section orthogonal thereto that is primarily circular and provides a slight under-cut/over-hang on an outside portion thereof in association with said flange; and wherein the other of said cover shell and said receiving shell has a similar flange for meeting the flange of said one of said receiving shell and said cover shell, the similar flange having a female nesting recess along the periphery thereof, the female nesting recess having a cross-section orthogonal thereto enabling snap-fit securement to the under-cut of the male engagement snap-fit protrusion.

12. A container according to claim 11, wherein the cross-section of said female nesting recess has an arc-section corresponding to an outside portion of the cross-section of the male engagement snap-fit protrusion.

13. A container according to claim 12, wherein the cross-section of the male engagement snap-fit protrusion is primarily circular spanning an arc-span of at least 180 degrees.

14. A container according to claim 13, wherein the cross-section of the female nesting recess has a primarily circular arc-section spanning an arc-span of at least 90 degrees.

15. A monolithic container for stabilizing a food dish therein, said container comprising:

a receiving shell defining a first cavity for receiving the food dish;

a cover shell releasably lockable to said receiving shell for providing a cover with a second cavity over said first cavity; and an hinge member connecting said receiving shell and said cover shell, said hinge member comprising a first flange extension coupled to said receiving shell and a second flange extension coupled to said cover shell;

wherein one of said first flange extension and said second flange extension comprises a protrusion and the other of said first flange extension and said second flange extension comprises a complimentary nesting recess, said protrusion and said nesting recess assisting lateral alignment of said cover shell over said receiving shell before being releasably locked thereto.

16. A monolithic container according to claim 15, wherein said protrusion comprises a protruding ridge running the length of said hinge member and substantially parallel to a fold line of said hinge member; and wherein said complimentary nesting recess comprises a recessed shelf running the length of said hinge member and substantially parallel to the fold line.

17. A monolithic container according to claim 16, wherein said protruding ridge and said recessed shelf each have reciprocal bends along their length.

18. A monolithic container according to claim 16, wherein said hinge member has a cross-section orthogonal to the fold line that includes two substantially circular U-shaped sections joined therebetween by a substantially squared intermediate interconnect.

19. A monolithic hinge member according to claim 16, wherein said hinge member has a cross-section orthogonal to the fold line that includes two substantially squared U-shaped sections joined therebetween by a substantially squared intermediate interconnect.

20. A monolithic container according to claim 16, wherein said cover shell comprises a sidewall with at least one inward projection, said at least one inward projection effecting entrapment of an edge of the food dish when seated within said receiving shell and said cover shell is releasably locked to said receiving shell.

21. A monolithic container according to claim 20, wherein said receiving shell comprises a sidewall with a plurality of inwardly directed ribs for preventing lateral movement of the food dish when seated therein.

22. A monolithic container according to claim 21, wherein at least one of said plurality of inwardly directed ribs comprises a plateau shoulder for supporting a flange of the good dish edge when seated in the receiving shell.

23. A monolithic container according to claim 22, wherein said at least one inward projection and the plateau shoulder define a vertical clearance plane therebetween of a thickness less than a rim of a pie tin so that when said cover shell is releasably locked to said receiving shell with the pie tin seated therein, said at least one inward projection exerts an entrapment force upon the crimped rim against the plateau shoulder.

24. A monolithic container according to claim 23 wherein said at least one inward projection has a width associated therewith for meeting a corresponding partial circumference of the edge of the pie tin when seated within the monolithic container and the monolithic container is closed.

25. A monolithic container according to claim 24, wherein the width of said at least one inward projection extends an arc-span of at least 5° degrees relative a circular outer circumference of the edge of the pie tin when seated within the container and the container is closed.

26. A container for stabilizing a pie tin including a bottom therein, said container comprising:

a receiving shell defining a first cavity for receiving the pie tin, the receiving shell having a floor and a sidewall with a plurality of inwardly directed ribs for meeting the pie tin and preventing lateral movement thereof when seated therein, and wherein the bottom of the pie tin is suspended above said floor when seated within said receiving shell;

a cover shell releasably lockable to said receiving shell for providing a cover with a second cavity over said first cavity, the cover shell having a sidewall with a plurality of inward projections for effecting entrapment of the pie tin when seated within said receiving shell and said cover shell is releasably locked thereto; and a hinge member connecting said receiving shell and said cover shell.

27. A container according to claim 26, wherein said receiving shell comprises a peripheral flange with a tab extension from a portion of the flange substantially opposite said hinge member; and wherein said cover shell comprises a peripheral flange with a similar tab extension, said tab extension and said similar tab extension being offset relative one another when said cover shell is releasably locked to said receiving shell.

28. A method of packaging a food dish comprising steps of:

placing a food dish within a receiving shell; and securing a cover shell to the receiving shell as a cover over the food dish;

wherein said step of securing includes providing an entrapment force upon a partial circumference of a peripheral edge of the food dish via the cover shell so as to stabilize the food dish within the receiving shell.

29. A method according to claim 24, wherein the cover shell is pivotally coupled to the receiving shell as a monolithic packaging container; and said step of securing comprises a step of folding the cover shell over and onto said receiving shell, the cover shell being folded about its pivotal coupling with the receiving shell.

30. A method according to claim 24, wherein the receiving shell and the cover shell include reciprocal snap-fit mating projection and recess respectively about respective peripheral flanges thereof; and wherein said step of securing comprises pressing the respective peripheral flanges together about the peripheries thereof until snap-fit mating the respective snap-fit mating projection and recess.

31. A method according to claim 28, wherein the receiving shell includes a floor and the food dish includes a bottom, and wherein said step of placing comprises placing the food dish within the receiving shell such that the bottom of the food dish is suspended above the floor of the receiving shell.

* * * * *